US008500122B2

(12) United States Patent
Kushida et al.

(10) Patent No.: US 8,500,122 B2
(45) Date of Patent: Aug. 6, 2013

(54) SHEET CONVEYING APPARATUS, SHEET PROCESSING APPARATUS, AND IMAGE FORMING APPARATUS

(75) Inventors: Hideki Kushida, Moriya (JP); Akito Sekigawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 286 days.

(21) Appl. No.: 13/104,103

(22) Filed: May 10, 2011

(65) Prior Publication Data

US 2011/0280625 A1 Nov. 17, 2011

(30) Foreign Application Priority Data

May 17, 2010 (JP) ..... 2010-113297
Apr. 8, 2011 (JP) ..... 2011-086662

(51) Int. Cl.
*B65H 5/06* (2006.01)

(52) U.S. Cl.
USPC ..... 271/274; 270/39.06; 399/122

(58) Field of Classification Search
USPC ..... 271/273, 274; 270/39.17, 39.06, 270/32; 399/122
See application file for complete search history.

(56) References Cited

U.S. PATENT DOCUMENTS

| | | | |
|---|---|---|---|
| 7,874,553 | B2 | 1/2011 | Kushida et al. |
| 2009/0115129 | A1 | 5/2009 | Kushida |
| 2010/0194037 | A1 | 8/2010 | Sekigawa |

FOREIGN PATENT DOCUMENTS

| | | |
|---|---|---|
| JP | 10-247028 | 9/1998 |
| JP | 2004-224554 | 8/2004 |

*Primary Examiner* — Michael McCullough
(74) *Attorney, Agent, or Firm* — Fitzpatrick, Cella, Harper & Scinto

(57) ABSTRACT

A roller separating mechanism rotates an upper roller-moving cam and a lower roller-moving cam at the same time, and swings the upper roller arm plate and the lower roller arm plate such that a pair of folding rollers separate from each other. When the pair of folding rollers are to be abutted against each other, the upper roller arm plate and the lower roller arm plate are swung with different timing in a direction in which the pair of folding rollers abut against each other.

12 Claims, 15 Drawing Sheets

SHEET CONVEYING APPARATUS, SHEET PROCESSING APPARATUS, AND IMAGE FORMING APPARATUS

BACKGROUND OF THE INVENTION

1. Field of the Invention

The present invention relates to a configuration for separating a pair of sheet conveying rollers which convey a sheet and which can separate from each other, and more particularly, to a sheet conveying apparatus, a sheet processing apparatus, and an image forming apparatus capable of reducing an impact force caused when a pair of sheet conveyance rotating members move from separated positions to an abutted position.

2. Description of the Related Art

A conventional image forming apparatus of an electrophotographic system such as a copying machine, a laser beam printer, a facsimile machine and a multifunctional machine thereof includes an image forming portion which forms a toner image on a sheet, and a fixing portion which fixes the toner image formed on the sheet. Some image forming apparatuses include a sheet processing apparatus which carries out bookbinding processing for a sheet on which a toner image is fixed. A conventional image forming apparatus and a sheet processing apparatus include a sheet conveying apparatus which conveys a sheet.

It is generally known that when bookbinding processing is carried out by the conventional sheet processing apparatus, after a predetermined number of sheets are superposed on each other to form a sheet bundle and then, central portions of the sheet bundle are bound by strings, staples, adhesives or the like, and binding portions are folded in the middle, thereby forming the sheet bundle into a booklet form. Some of the conventional sheet processing apparatuses include a folding plate and two pairs of folding rollers arranged side by side in a sheet-pushing direction for carrying out the bookbinding processing. When sheets are folded in the middle, binding portions of the sheet bundle are sequentially pushed into nip portions of a pair of upstream folding rollers and a pair of downstream folding rollers in the sheet-pushing direction by the folding plate, thereby folding the sheet bundle in the middle.

In the case of the sheet processing apparatus of such a configuration, if the number of sheets is increased, when the folding plate is moved backward after the folding operation which is carried out by pushing the sheet bundle by the folding plate is completed, a moving load at the time of the backward moving operation is increased by a nip pressure of the pair of folding rollers. Hence, to reduce the moving load, the pair of folding rollers located upstream in the sheet-pushing direction are separated from each other after the folding operation, thereby opening a space between the pair of rollers.

To separate the pair of folding rollers from each other, a pair of swinging members support two pairs of folding rollers, and a turning center of the swinging members is set downstream from the pair of downstream folding rollers in the sheet-pushing direction. By the roller moving mechanism having such a configuration, when a sheet bundle reaches the pair of downstream folding rollers, the pair of upstream folding rollers are moved in the separating direction by an arm ratio between a sheet bundle thickness and the turning center of the swinging members (see Japanese Patent Laid-Open No. 2004-224554).

In the conventional sheet conveying apparatus, the pair of folding rollers whose abutting pressure of the rollers is set relatively high and a pair of thermal fixing rollers are moved between the abutted position and the separated positions by the roller moving mechanism having the swinging member and a cam mechanism.

In the conventional sheet conveying apparatus having the roller moving mechanism, in the case of the roller moving mechanism disclosed in Japanese Patent Laid-Open No. 2004-224554, the single swinging member supports the plurality of (pair of) folding rollers. In the case of such a configuration, the pair of folding rollers are moved in the separating direction only by the thickness of the sheet bundle. Therefore, the moment a rear end of the sheet bundle passes through the pair of downstream folding rollers, the pair of upstream and downstream folding rollers simultaneously try to move in the abutting direction by the spring effect.

Also some of conventional roller moving mechanisms include an eccentric cam on one of roller ends as a unit configured to separate and abut a pair of heat fixing rollers from and against each other (see Japanese Patent Laid-Open No.10-247028). Due to characteristics of a cam mechanism, a load direction of a rising side of a cam curve (moving direction in which a cam follower separates from the center shaft) and a load direction of a lowering side of the cam curve (moving direction in which the cam follower approaches the center shaft) are changed at the top dead center (point of the cam follower which is furthest from the center shaft) as a boundary.

That is, a rising side of the cam curve becomes drag when the cam follower is pushed up by a pressurizing force for contacting a pair of rollers under pressure, and a lowering side of the cam curve becomes an assisting force for pushing down the cam follower by a pressurizing force of the pair of rollers. Therefore, the tooth abutting surface moves between backlashes of a gear in a driving transmission portion at a load changing point at this top dead center as a boundary. Especially when a gear is provided on the cam shaft or the like, the load changing point of the cam and a phase angle of a teeth where a teeth abutting surface of a gear match with each other. As a result, a repeatedly impact load is applied to a specific teeth, and it is considered that there are problems that a teeth surface is damaged and a collision sound is generated.

SUMMARY OF THE INVENTION

The present invention has been accomplished in view of the above circumstances, and provides a sheet conveying apparatus, a sheet processing apparatus, and an image forming apparatus capable of reducing the impact force caused when a pair of sheet conveyance rotating members such as a pair of rollers move from the separated positions to the abutted position.

The present invention provides a sheet conveying apparatus comprising a pair of sheet conveyance rotating members including a first rotating member and a second rotating member which nip a sheet and convey the sheet, and a moving mechanism which brings the first rotating member and the second rotating member into contact with each other and which separates the first rotating member and the second rotating member from each other, wherein the moving mechanism includes a first cam which moves, against a biasing force in a direction in which the first rotating member abuts against the second rotating member, the first rotating member so that the first rotating member separates from the second rotating member, a second cam which moves, against a biasing force in a direction in which the second rotating member abuts against the first rotating member, the second rotating member so that the second rotating member separates from the first rotating member, and a driving portion which drives the first cam and the second cam, wherein each of the first cam and the second cam has such a cam curved surface that when the first cam and the second cam are rotated by the driving portion, each cam curved surface moves the first rotating member and the second rotating member to each maximum separated position where the first rotating member and the second rotating member are separated from each other, and when the first rotating member and the second rotating member are abutted against each other, each cam curved surface moves the first rotating member and the second rotating member with different timing from each maximum separated position.

According to the present invention, when the first rotating member and the second rotating member which can separate from each other are abutted against each other, the first rotating member and the second rotating member are moved with different timing. According to this configuration, it is possible to reduce the impact force caused when a pair of sheet conveyance rotating members such as the pair of rollers move from the separated positions to the abutted position.

Further features of the present invention will become apparent from the following description of exemplary embodiments with reference to the attached drawings.

DESCRIPTION OF THE EMBODIMENTS

Figure 1:
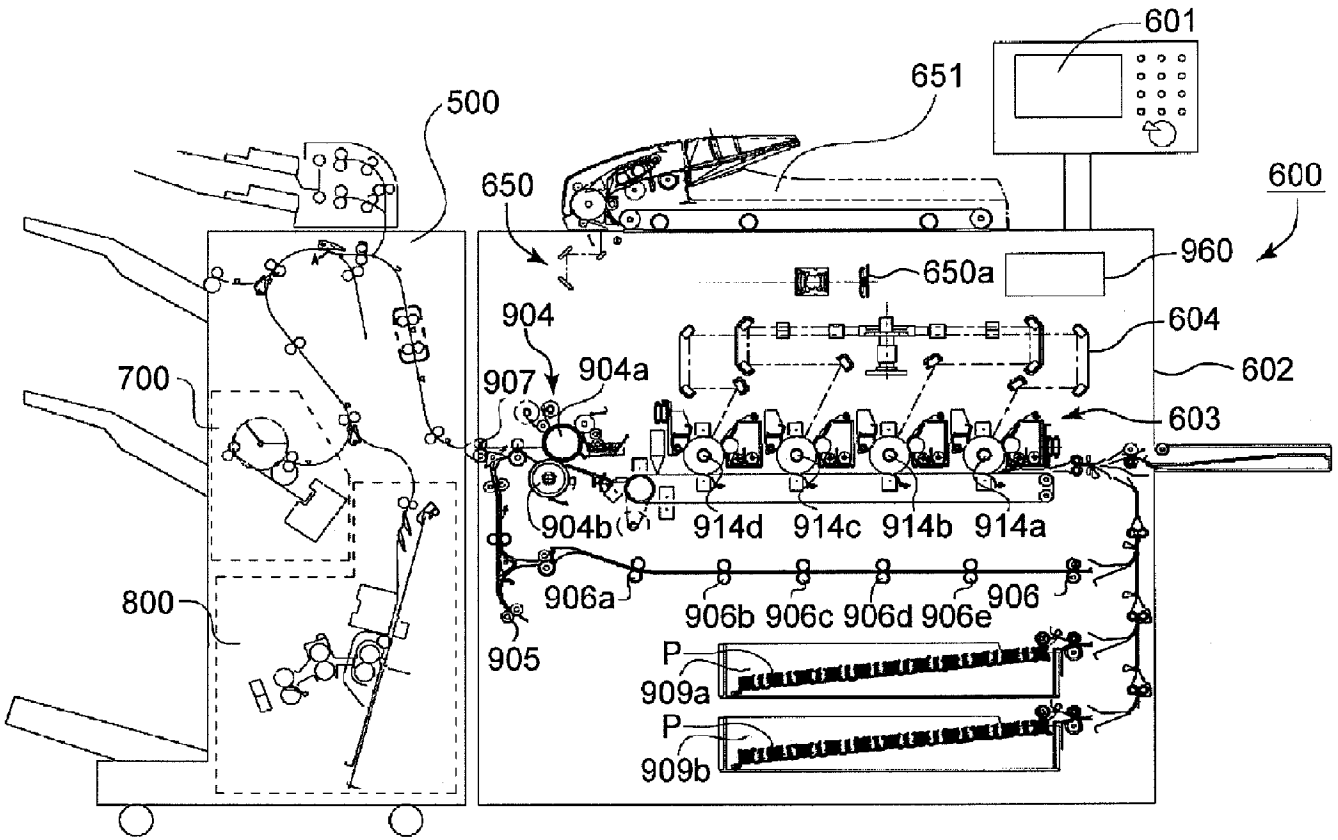
FIG. 1 is a diagram illustrating a configuration of an image forming apparatus including a sheet conveying apparatus and a sheet processing apparatus according to an embodiment of the present invention.

An embodiment for carrying out the present invention will be described in detail based on the drawings. FIG. 1 is a diagram illustrating a configuration of an image forming apparatus including a sheet conveying apparatus and a sheet processing apparatus according to the embodiment of the invention.

In FIG. 1, an image forming apparatus 600 includes an image forming apparatus body (apparatus body, hereinafter) 602, a document reading portion (image reader) 650 provided on an upper portion of the apparatus body 602, and a document feeding apparatus 651 which automatically reads a plurality of documents.

The apparatus body 602 includes sheet cassettes 909*a* and 909*b* in which plain sheets P are stacked. Images are formed on the plain sheets P. The apparatus body 602 also includes an image forming portion 603 which forms a toner image on a sheet using an electrophotographic process, and a fixing portion 904 which fixes a toner image formed on a sheet. An operation portion 601 is connected to an upper surface of the apparatus body 602 through which a user inputs and sets various pieces of information to and in the apparatus body 602. A finisher 500 which is a sheet processing apparatus is connected to a side of the apparatus body 602. A CPU circuit 960 which is a controlling portion for controlling the apparatus body and the finisher 500.

In the image forming apparatus 600, when an image of a document (not illustrated) is formed on a sheet, an image sensor 650*a* provided in the document reading portion 650 reads an image of a document conveyed by the document conveying apparatus 651. Then, the read digital data is input to an exposing portion 604, and the exposing portion 604 irradiates photosensitive drums 914 (914*a* to 914*d*) provided in the image forming portion 603 with light which corresponds to the digital data. If the photosensitive drums are irradiated with light, electrostatic latent images are formed on the photosensitive drums, and if the electrostatic latent images are developed, toner images of each of yellow, magenta, cyan and black are formed on surfaces of the photosensitive drums.

Next, toner images of four colors are transferred onto a sheet fed from the sheet cassettes 909*a* and 909*b*. Then, the toner image transferred onto the sheet is permanently fixed by the fixing portion 904. After the toner image is fixed, if a one-sided copy/print mode is selected, the sheet is discharged from a pair of discharge rollers 907 to the finisher 500 as it is.

If a two-sided copy/print mode is selected, a sheet is delivered from the fixing portion 904 to reverse rollers 905 and then, the reverse rollers 905 are reversely rotated with predetermined timing, and the sheet is conveyed toward the two-sided conveying rollers 906*a* to 906*f*. Then, the sheet is conveyed to the image forming portion 603 again, and toner images of four colors, i.e., yellow, magenta, cyan, and black are transferred onto a back surface of the sheet. The sheet having the back surface on which the four color toner images are formed is again conveyed to the fixing portion 904, the toner images are fixed, the sheet is discharged from the pair of discharge rollers 907, and conveyed to the finisher 500 which is connected to the side of the apparatus body 602.

The finisher 500 takes, in sequence, sheets discharged from the apparatus body 602, carries out processing for aligning a plurality of taken sheets to bind them as one bundle, and punching processing for punching holes in rear ends of the taken sheets. The finisher 500 carries out stapling processing (binding processing) for stapling a rear end of a sheet bundle, and includes a stapling portion 700 which staples sheets, and a saddle stitch bookbinding apparatus 800 which folds a sheet bundle in the middle and binds the same.

Figure 2:
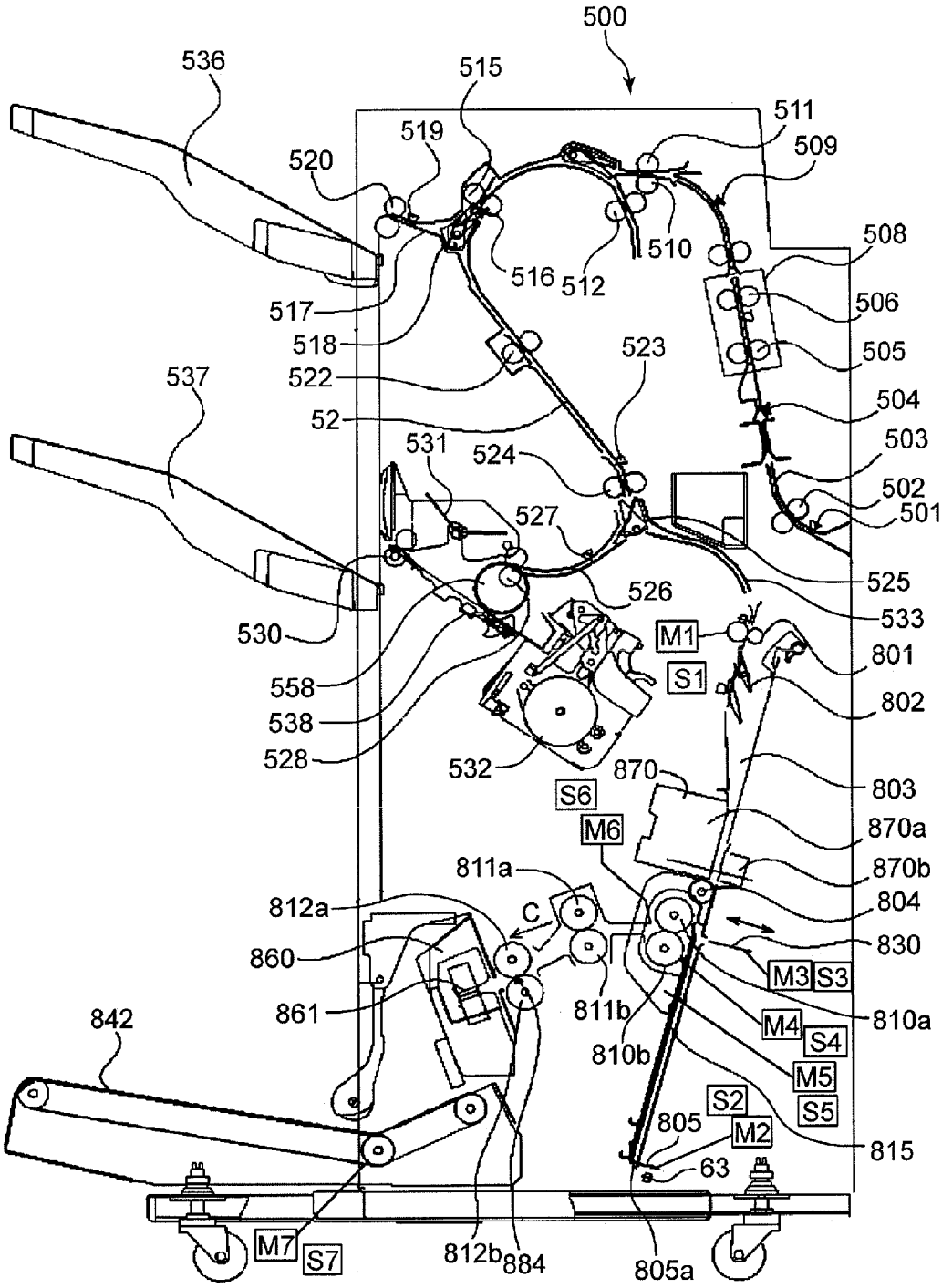
FIG. 2 is a diagram for explaining a configuration of a finisher which is the sheet processing apparatus.

As illustrated in FIG. 2, the finisher 500 includes a pair of inlet rollers 502 for taking a sheet into the apparatus, and a sheet discharged from the apparatus body 602 is delivered to the pair of inlet rollers 502. At that time, the delivering timing of the sheet is also detected by an inlet sensor 501 at the same time.

Thereafter, the sheet conveyed by the pair of inlet rollers 502 passes through a conveying path 503 and during that time, an end position of the sheet is detected by a lateral registration detection sensor 504, and the lateral registration detection sensor 504 detects whether the sheet is deviated in the width direction and detects how much the sheet is deviated with respect to a center (central) position of the finisher 500. After the deviation (lateral registration error, hereinafter) in the width direction is detected, while a pair of shift rollers 505 and 506 convey the sheet, a shift unit 508 moves to a near side or a deeper side by a predetermined length, thereby carrying out a shift operation of the sheet.

Next, the sheet is conveyed by a conveying roller 510 and a separating roller 511 and reaches a pair of buffer rollers 515. Thereafter, when the sheet should be discharged into an upper tray 536, an upper path switching member 5118 is brought into a state illustrated with a broken line in the drawing by a driving portion such as a solenoid (not illustrated). According to this, the sheet is guided by an upper path conveying passage 517 and discharged into the upper tray by an upper discharge roller 520.

When the sheet should not be discharged into the upper tray 536, the sheet conveyed by the pair of buffer rollers 515 is guided into a bundle-conveying path 521 by an upper path switching member 518 in a state illustrated with a solid line. Thereafter, the sheet passes through the conveying path in sequence by a conveying roller 522 and a pair of bundle-conveying rollers 524. Next, when the conveyed sheet should be discharged into a lower stack tray 537, the sheet is conveyed to a lower path 526 by a saddle path switching member 525 in a state illustrated with a solid line. Thereafter, the sheet is discharged into an intermediate processing tray 538 by a pair of lower discharge rollers 528. The discharged sheets are stacked sequentially by the paddle 531 and the belt conveyer 558 and in this state, the sheets are aligned, and a predetermined number of sheets are aligned on an intermediate processing tray as a sheet stacking portion which carries out processing for the aligned and stacked sheet bundle.

Next, the sheet bundle which was aligning on the intermediate processing tray is subjected to a binding processing by a stapler 532 which constitutes a binding portion as need arises and then, the sheet is discharged to a lower stack tray 537 by a pair of bundle discharge rollers 530. The stapler 532 can move in a direction (deep direction, hereinafter) perpendicular to a sheet discharging direction and bind a plurality of locations of rear ends of the sheet bundle.

When the sheet should be subjected to saddle (saddle stitch) processing, a saddle path switching member 525 is moved to a position illustrated with a broken line by the driving portion such as the solenoid (not illustrated). According to this, the sheet is conveyed to a saddle path 533, and guided to a saddle stitch bookbinding apparatus 800 by a pair of saddle inlet rollers 801.

Next, the sheet sent to the saddle stitch bookbinding apparatus 800 is delivered to the pair of saddle inlet rollers 801, a switching member 802 which operates by solenoid selects a conveying port according to size, and the sheet is conveyed into an accommodation guide 803 as a sheet stacking portion. The conveyed sheet is continuously conveyed by a sliding roller 804 having sliding properties on a roller surface.

The pair of saddle inlet rollers 801 and the sliding roller 804 are driven by a saddle stitch inlet roller motor M1 and controlled by a saddle stitch inlet sensor S1. The sheet conveyed by the accommodation guide 803 is conveyed until an end (downstream end in the conveying direction) of the sheet abuts against an end stopper 805 which was previously moved to a predetermined position according to a sheet size (length of the sheet in the conveying direction). The end stopper 805 is controlled by an end stopper movement sensor S2, can move in the sheet conveying direction along a sheet guide surface of the accommodation guide 803, and can be driven by the end stopper moving motor M2 and moved in the sheet conveying direction. The end stopper 805 includes a limiting surface 805*a* which projects from the accommodation guide 803, and the limiting surface 805*a* receives a downstream end (in the sheet conveying direction) of the sheet conveyed by the accommodation guide 803 and holds the sheet.

A stapler 870 is provided at an intermediate portion of the accommodation guide 803 such as to be opposed to each other with the accommodation guide 803 interposed therebetween. The stapler 870 is a binding portion which binds a central portion (in the conveying direction) of a bundle of a plurality of sheets accommodated in the accommodation guide 803. The stapler 870 is divided into a driver 807*a* which inserts a needle into sheets, and an anvil 807*b* which bends the inserted needle, and if an accommodating operation of sheets is completed, a central portion of a sheet bundle in the conveying direction is bound with needles.

A pair of folding rollers 810*a* and 810*b* constituting a folding portion which folds a sheet bundle accommodated in the accommodation guide 803 in the middle at its central portion in the conveying direction, and a projecting member 830 are provided downstream of the stapler 870 such that the pair of folding rollers 810*a* and 810*b* and the projecting member 830 are opposed to each other with the accommodation guide 803 interposed therebetween. The projecting member 830 projects toward the central portion of the sheet bundle in the conveying direction accommodated in the accommodation guide 803 by driving the projection motor M3. By this projecting motion, the sheet bundle is pushed into nips of the pair of folding rollers 810*a* and 810*b* and in this state, and the sheet bundle can be folded in the middle at its central portion.

After the projecting operation of the sheet bundle by the projecting member 830 is completed and a tip end of the sheet bundle on the side of its crease reaches a pair of first folding conveyance rollers 811*a* and 811*b*, the pair of folding rollers 810*a* and 810*b* are brought into a separated state from a pressure-contact by a later-described roller 830 moving mechanism. Then, the projecting member is returned to its home position. The home position of the projecting member 830 is a position retracted from the accommodation guide 803, and the home position is controlled by a projection sensor S3. The pair of folding rollers 810*a* and 810*b* are brought into the separated state from the pressure-contact state. Then, it is possible to reduce a load resistance caused by a nip pressure of the pair of folding rollers 810*a* and 810*b* when the projecting member 830 returns at the return of the projecting member 830.

The pair of folding rollers 810*a* and 810*b* make a crease in the sheet bundle, and the sheet bundle is conveyed by the pair of first folding conveyance rollers 811*a* and 811*b* and a pair of second folding conveyance rollers 812*a* and 812*b*. After a tip end of the sheet bundle is conveyed to a press unit 860, the pair of first folding conveyance rollers 811*a* and 811*b* and the pair of second folding conveyance rollers 812*a* and 812*b* are stopped to stop the sheet bundle.

Thereafter, a folded back portion of the sheet bundle (booklet) whose conveying operation is stopped is pressed by a pair of press rollers 861 of the press unit 860 and in this state, the pair of press rollers 861 are moved along the crease of the booklet, and the crease is subjected to a re-creasing processing. After the sheet bundle is subjected to the re-creasing processing by the press unit 860, the booklet is again conveyed in the downstream direction, and is discharged into a folded bundle discharge tray 842. The folded bundle discharge tray 842 rotates and moves a conveyer on a tray surface by the folded bundle discharge tray motor M7, moves the discharged sheet bundle while performing control by the folded bundle discharge tray sensor S7 in sequence in the downstream direction, and stacks the sheet bundle.

Figure 3:
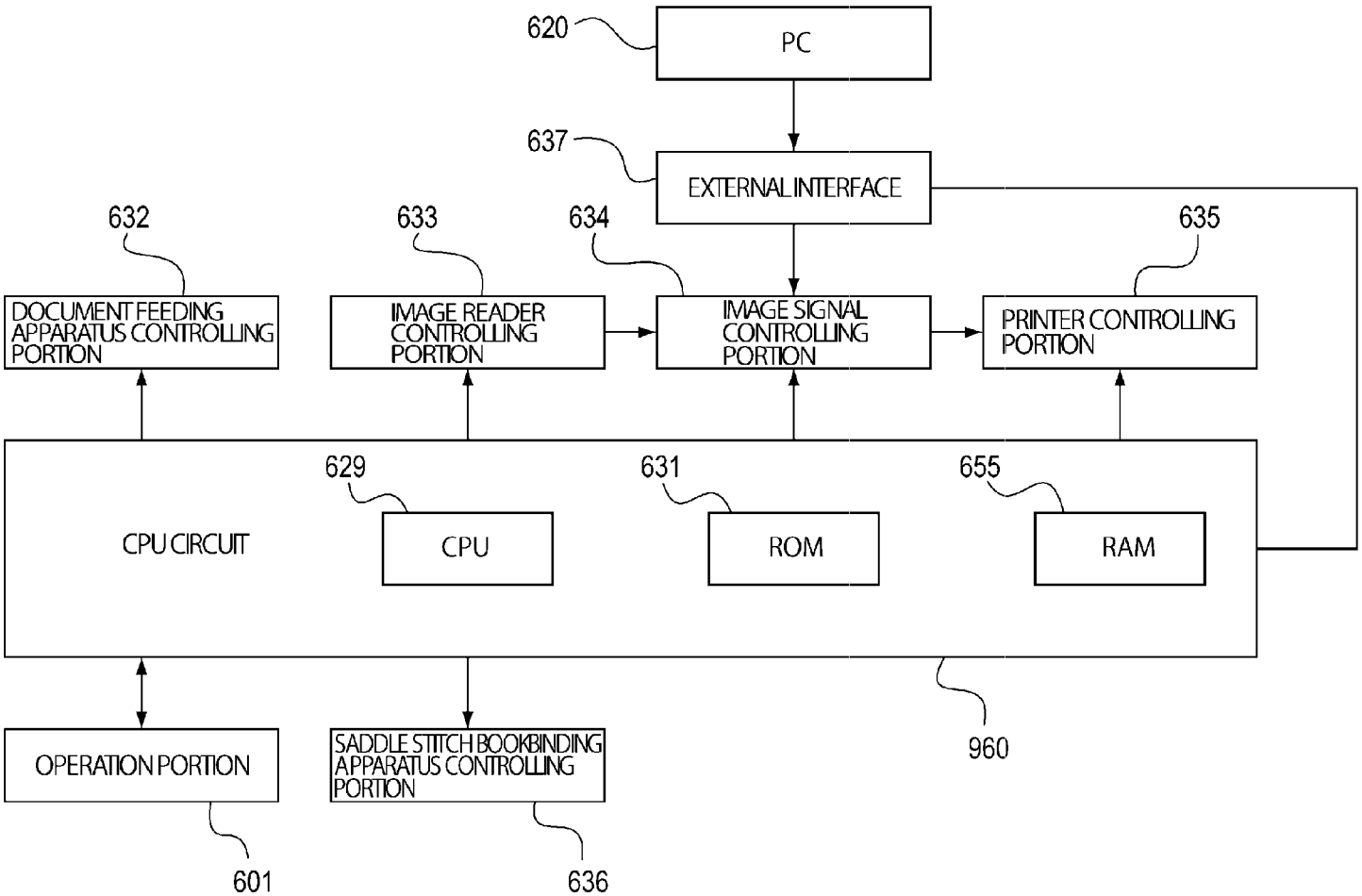
FIG. 3 is a control block diagram for controlling the image forming apparatus and a saddle stitch bookbinding apparatus provided in the finisher.

FIG. 3 is a control block diagram for controlling the image forming apparatus 600 and the saddle stitch bookbinding apparatus 800. As illustrated in FIG. 3, the CPU circuit 960 includes a CPU 629, a ROM 631, and a RAM 655. The CPU circuit 960 controls a document feeding apparatus controlling portion 632, an image reader controlling portion 633, an image signal controlling portion 634, a printer controlling portion 635, a saddle stitch bookbinding apparatus controlling portion 636 and an exterior interface 637. The CPU circuit 960 controls them according to a program stored in the ROM 631 and setting of the operation portion 601.

The document feeding apparatus controlling portion 632 controls the document feeding apparatus 651, and the image reader controlling portion 633 controls the document reading portion (image reader) 650. The printer controlling portion 635 controls the apparatus body 602. The saddle stitch bookbinding apparatus controlling portion 636 is provided in a finisher controlling portion (not illustrated) mounted in the finisher 500 and controls the saddle stitch bookbinding apparatus 800. In this embodiment, a configuration in which the finisher controlling portion (saddle stitch bookbinding apparatus controlling portion 636) is mounted in the saddle stitch bookbinding apparatus 800 will be described. However, the present invention is not limited to this configuration, and the finisher controlling portion (saddle stitch bookbinding apparatus controlling portion 636) may be provided such that the finisher controlling portion is integral with the CPU circuit 960 in the apparatus body 602, and the saddle stitch bookbinding apparatus 800 may be controlled from the side of the apparatus body 602.

The RAM 655 is used as an area where control data is temporarily stored and used as a working area for computation required for control. The exterior interface 637 is an interface from a computer (PC) 620, develops print data into an image, and outputs the same to the image signal controlling portion 634. An image which has been read by the image sensor is output from the image reader controlling portion 633 to the image signal controlling portion 634, and an image which has been output from the image signal controlling portion 634 to the printer controlling portion 635 is input to an exposure controlling portion.

In this embodiment, the saddle stitch bookbinding apparatus controlling portion 636 sends and receives information to and from the CPU circuit 630, thereby controlling a driving operation of the finisher 500. The saddle stitch bookbinding apparatus controlling portion 636 may be disposed on the side of the apparatus body integrally with the CPU circuit 630, and may control the finisher 500 directly from the side of the apparatus body.

Figure 4:
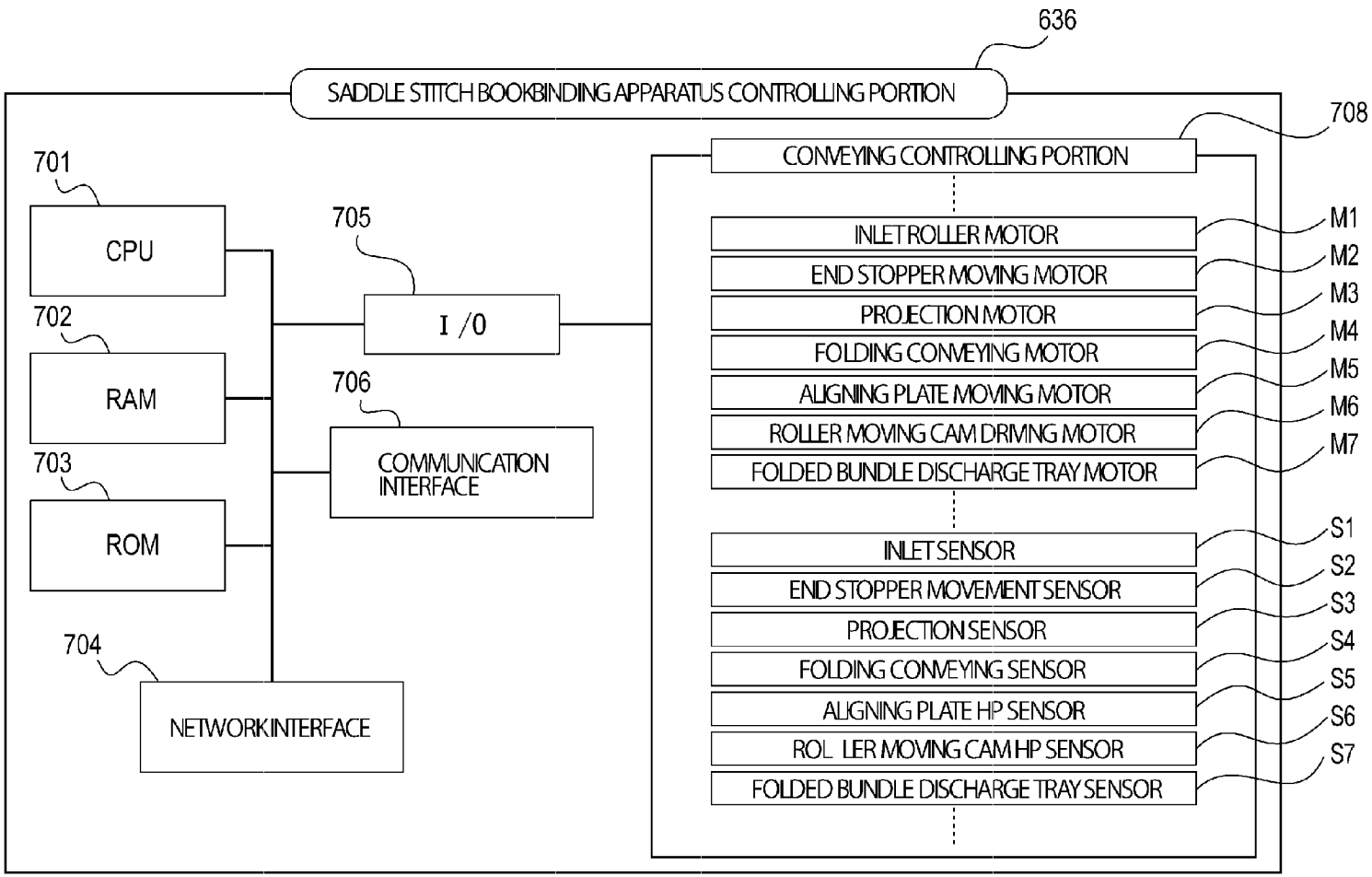
FIG. 4 is a control block diagram of the saddle stitch bookbinding apparatus.

FIG. 4 is a control block diagram of the saddle stitch bookbinding apparatus 800 of the embodiment. As illustrated in FIG. 4, the saddle stitch bookbinding apparatus controlling portion 636 includes a CPU (microcomputer) 701, a RAM 702, a ROM 703, an input/output portion (I/O) 705, a communication interface 706 and a network interface 704. Various sensor signals are input to an input port of the input/output portion (I/O) 705. A control block (not illustrated) is connected to an output port of the input/output portion (I/O) 705. Driving systems are also connected to the output port of the input/output portion (I/O) 705 through various drivers (not illustrated).

The CPU 701 controls a driving operation of an inlet roller motor M1 by an inlet sensor S1 through the conveying controlling portion 708, controls a driving operation of an end stopper moving motor M2 by an end stopper movement sensor S2, and controls a driving operation of a projection motor M3 by a projection sensor S3. The CPU 701 further controls a driving operation of a folding conveyance motor M4 by a folding conveyance sensor S4 through the conveying controlling portion 708, and controls a driving operation of an aligning plate moving motor M5 by an aligning plate HP sensor S5. The CPU 701 further controls a driving operation of a roller moving cam driving motor M6 by a roller moving cam HP sensor S6, and controls a driving operation of a folded bundle discharge tray motor M7 by a folded bundle discharge tray sensor S7.

Figure 5:
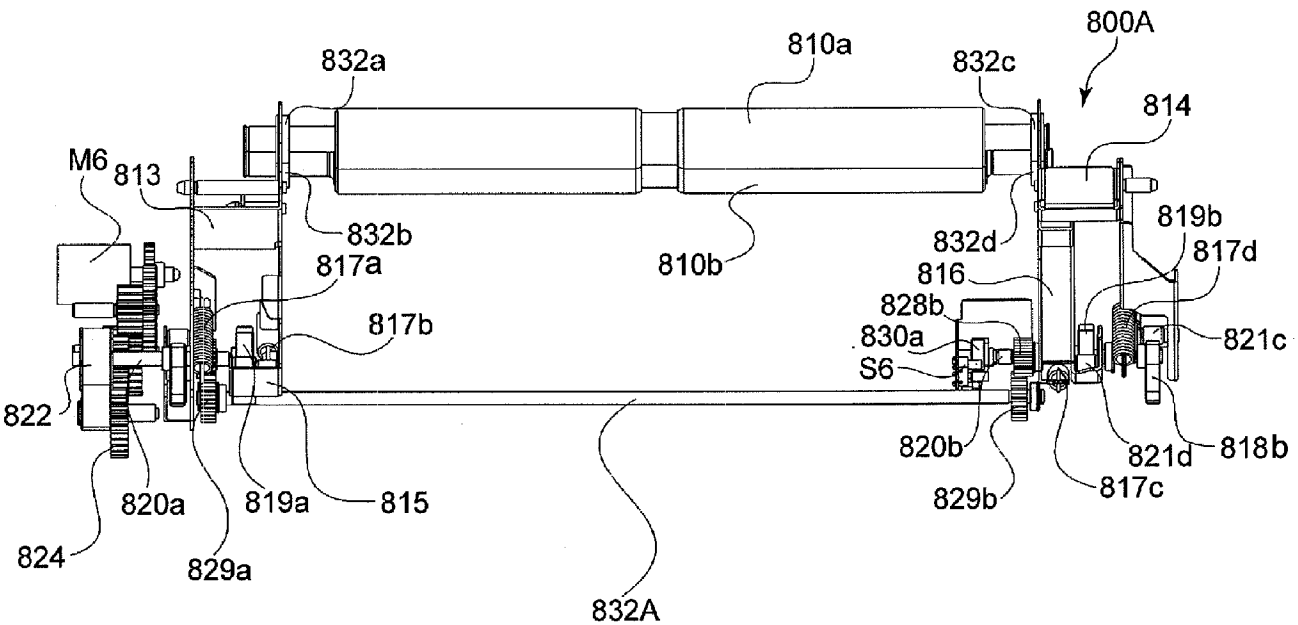
FIG. 5 is a plan view of a roller moving mechanism which is provided in the saddle stitch bookbinding apparatus for moving a pair of folding rollers.
Figure 6:
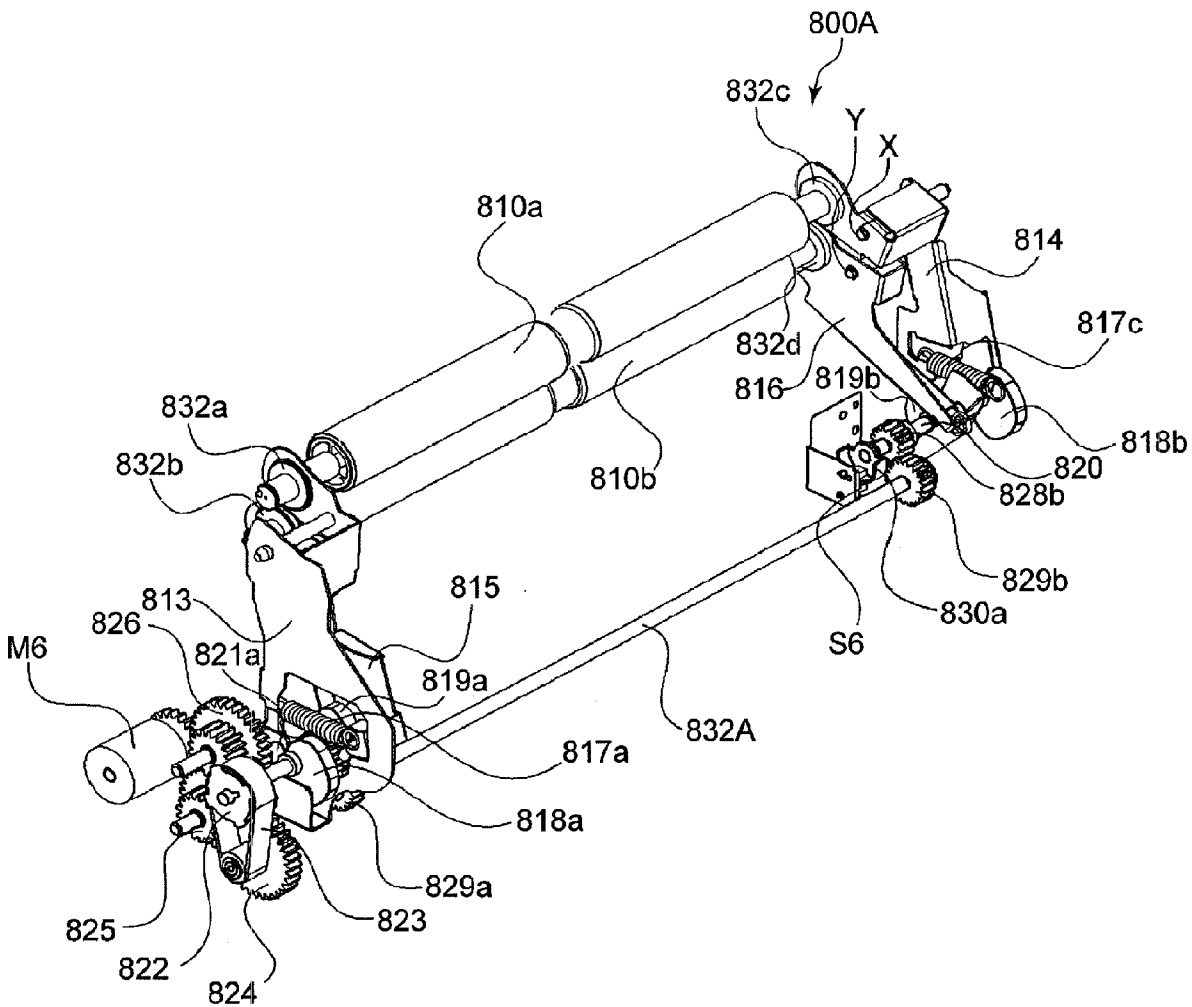
FIG. 6 is a perspective view of the roller moving mechanism.
Figure 7:
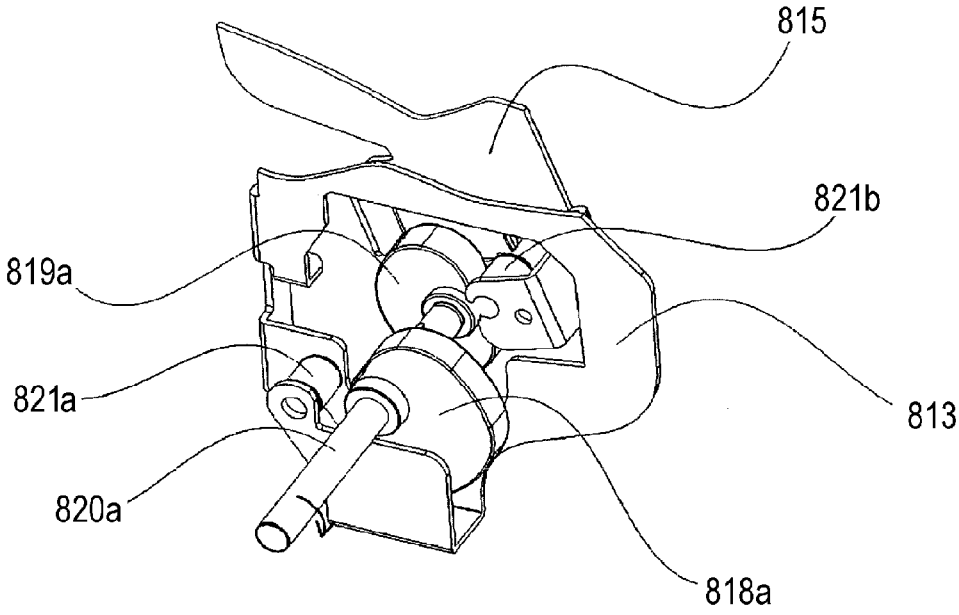
FIG. 7 is a partial diagram illustrating the roller moving mechanism in detail.

FIG. 5 is a perspective view of a roller moving mechanism 800A which is a moving mechanism for contacting and separating, to and from each other, the pair of folding rollers 810*a* and 810*b* which are a pair of sheet conveyance rotating members. FIG. 6 is a plan view thereof. FIG. 7 is a partial detailed diagram of the roller moving mechanism. As illustrated in FIGS. 5 to 7, the pair of folding rollers 810*a* and 810*b* are supported by an upper roller arm plate (front side) 813, an upper roller arm plate (deep side) 814, a lower roller arm plate (front side) 815 and a lower roller arm plate (deep side) 816 through bearing members 832*a* to 832*d*.

In the embodiment, the folding roller 810*a* which is the first rotating member constituting the pair of folding rollers 810*a* and 810*b* and which can contact and separate is rotatably supported by the upper roller arm plates 813 and 814 which are opposed to each other and which are first moving members. The folding roller 810*b* which is a second rotating member is rotatably supported by the lower roller arm plates 815 and 816 which are opposed to each other and which are second moving members.

The upper roller arm plates 813 and 814 and the lower roller arm plates 815 and 816 are biased by pressing springs 817*a* to 817*d* which are locked with a side plate (not illustrated) of the saddle stitch bookbinding apparatus 800 such that the pair of folding rollers 810*a* and 810*b* come into contact under pressure. The upper roller arm plates 813 and 814 and the lower roller arm plates 815 and 816 rotatably support the pair of folding rollers 810*a* and 810*b* on one ends thereof, and are swingably supported on the side plate of the saddle stitch bookbinding apparatus 800 through shafts X and Y.

Abutment rollers 821*a* to 821*d* are rotatably disposed on the other ends of the upper roller arm plates 813, 814, and the lower roller arm plates 815 and 816. Upper roller-moving cams 818*a* and 818*b* and lower roller-moving cams 819*a* and 819*b* are disposed in the roller moving mechanism 800A such that they act on the upper roller arm plates 813 and 814 and the lower roller arm plates 815 and 816. The upper roller-moving cams 818*a* and 818*b* and the lower roller-moving cams 819*a* and 819*b* are provided on both ends of the pair of folding rollers 810*a* and 810*b* in their axial direction.

Driving of a roller moving cam driving motor M6, which is the same driving source, is transmitted to the driving pulley 822 through driving transmission gears 824 to 826 and a timing belt 823. Rotation driving is transmitted from the moving cam driving shaft (front side) 820*a* and the driving transmission gear 829*a* fixed to the moving cam driving shaft 820*a* to the driving transmission shaft 832A, the driving transmission gears 828*b* and 829*b* and the moving cam driving shaft (deep side) 820*b* through the driving pulley 822. According to this, the upper roller-moving cams 818*a* and 818*b* and the lower roller-moving cams 819*a* and 819*b* fixed to the moving cam driving shafts 820*a* and 820*b* rotate in synchronization by the roller moving cam driving motor M6 and the driving transmission gears 824 to 826.

Here, the upper roller-moving cams 818*a* and 818*b* which are first cams and the upper roller arm plates 813 and 814 constitute a first moving portion, and the lower roller-moving cams 819*a* and 819*b* which are second cams and the lower roller arm plates 815 and 816 constitute a second moving portion. If the upper roller-moving cams 818*a* and 818*b* and the lower roller-moving cams 819*a* and 819*b* rotate in synchronization, the upper roller arm plates 813 and 814 and the lower roller arm plates 815 and 816 swing around the shafts X and Y. As the upper roller arm plates 813 and 814 and the lower roller arm plates 815 and 816 move, the pair of folding rollers 810*a* and 810*b* separate from and abut against each other.

Figure 8A:
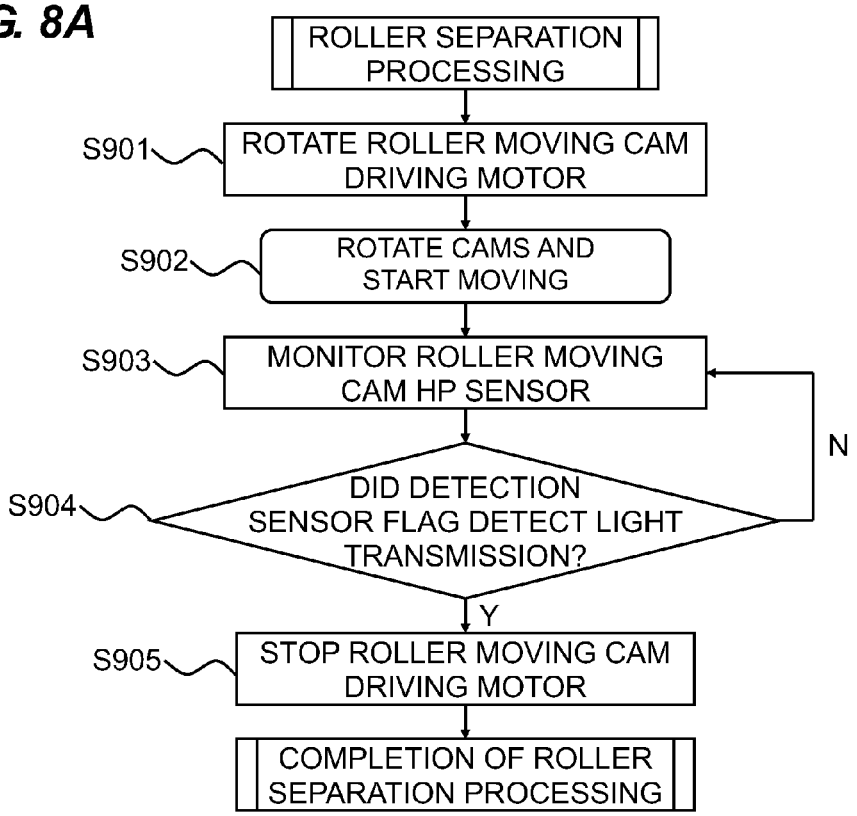
FIGS. 8A and 8B are flowcharts for explaining an operation for separating the pair of folding rollers from each other and for bringing the pair of folding rollers into abutment against each other.
Figure 8B:
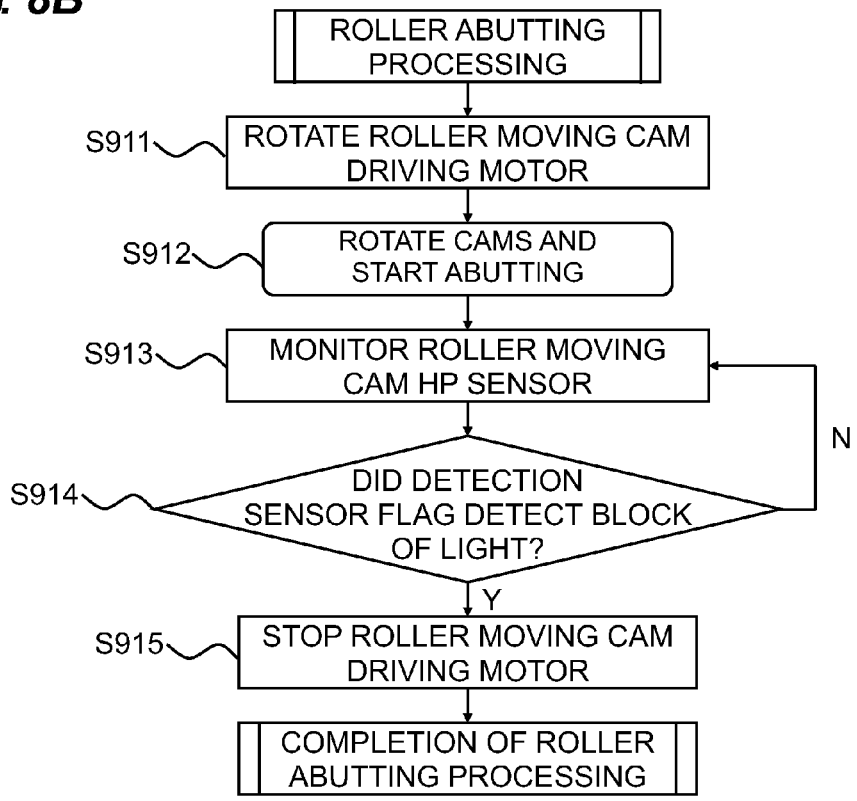
Figure 9A:
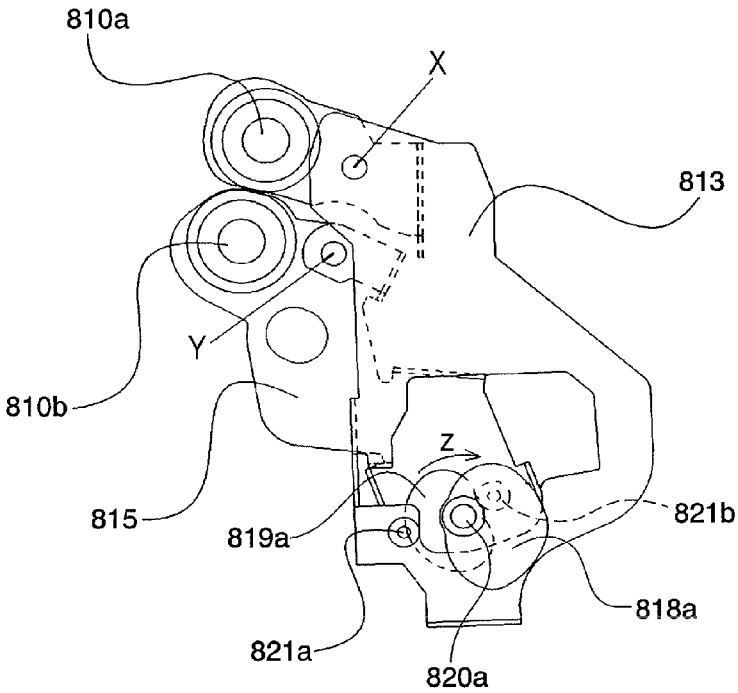
FIGS. 9A and 9B are diagrams for explaining the operation for separating the pair of folding rollers from each other and for bringing the pair of folding rollers into abutment against each other.
Figure 9B:
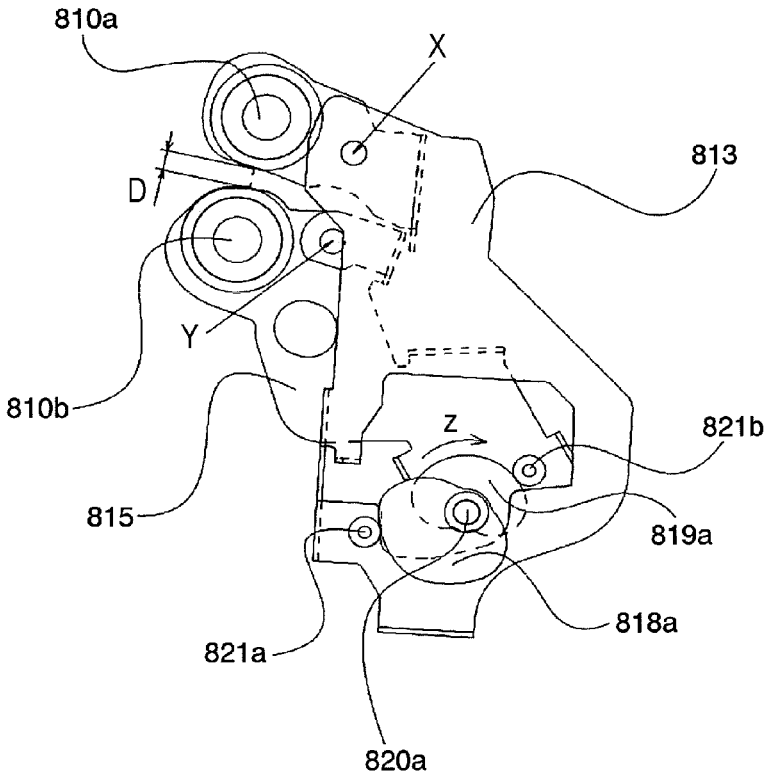
Figure 10:
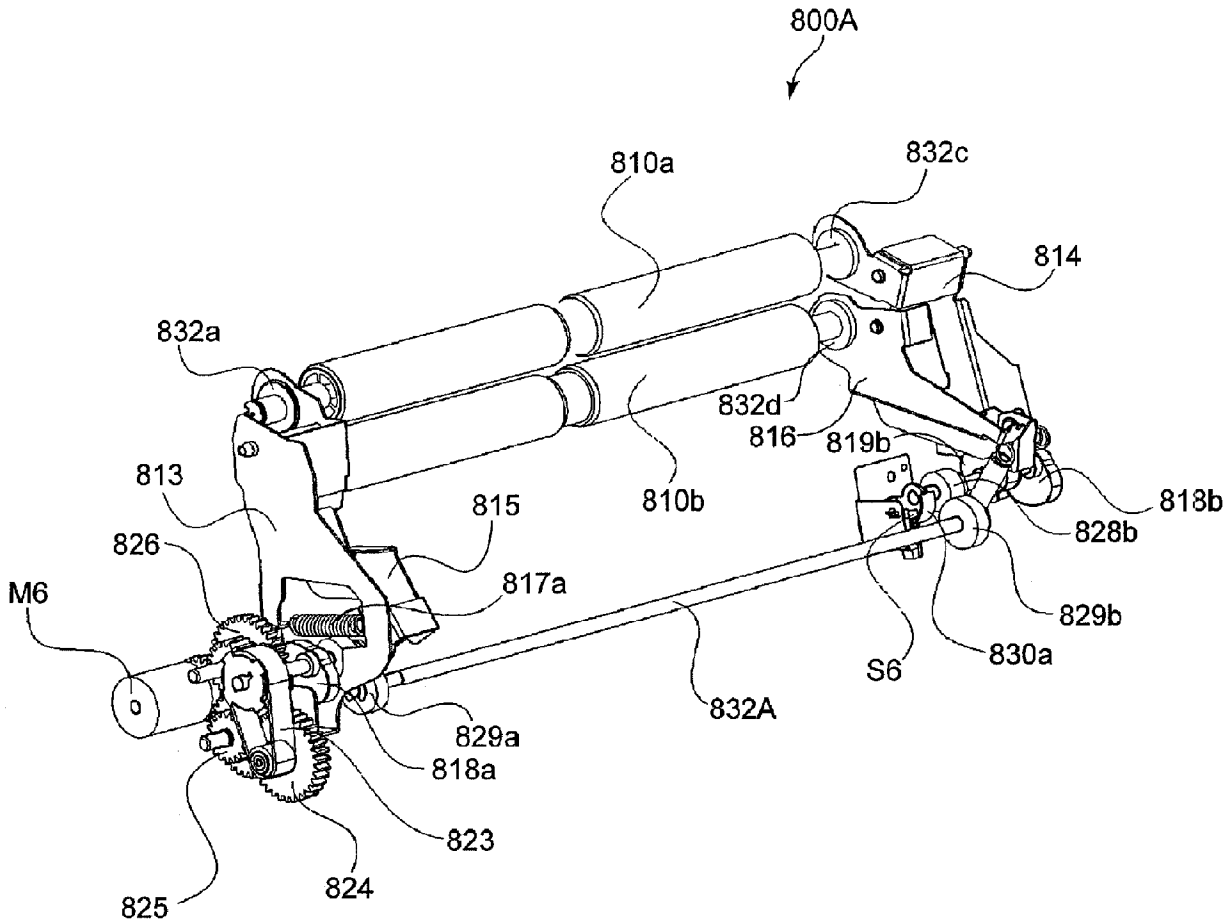
FIG. 10 is a perspective diagram illustrating a state where the pair of folding rollers are separated from each other.

Next, an operation for separating and abutting, from and against each other, the pair of folding rollers 810*a* and 810*b* as the upper roller arm plates 813 and 814 and the lower roller arm plates 815 and 816 move will be described with reference to flowcharts in FIGS. 8A and 8B and with reference to FIGS. 9A, 9B, and 10. FIGS. 9A, 9B, and 10 are diagrams for explaining an operation for moving the upper roller arm plate 813 and the lower roller arm plate 815 by the upper roller-moving cam 818*a* and the lower roller-moving cam 819*a*. This operation is the same as movements of the upper roller arm plate 814 and the lower roller arm plate 816 caused by the upper roller-moving cam 818*b* and the lower roller-moving cam 819*b*.

As described above, if the projecting operation of the sheet bundle by the projecting member 830 is completed and a tip end of the sheet bundle on the side of the crease reaches the pair of first folding conveyance rollers 811*a* and 811*b*, the roller separation processing is started. In this case, the saddle stitch bookbinding apparatus controlling portion 636 first rotates the roller moving cam driving motor M6 (S901). According to this, the moving cam driving shaft (front side) 820*a* which is the cam shaft rotates in the direction of arrow Z (clockwise direction) as illustrated in FIG. 9A, the upper roller-moving cam 818*a* and the lower roller-moving cam 819*a* fixed to the same shaft of the moving cam driving shaft (front side) 820*a* also rotate in the direction of arrow Z.

Next, if the upper roller-moving cam 818*a* and the lower roller-moving cam 819*a* rotate, abutment rollers 821*a* and 821*b* respectively soon abut against cam surfaces of the upper roller-moving cam 818*a* and the lower roller-moving cam 819*a*. At that time, the abutment rollers 821*a* and 821*b* come into contact with cam curved surfaces of the upper roller-moving cam 818*a* and the lower roller-moving cam 819*a* under pressure by pressing springs 817*a* and 817*b*.

According to this, the upper roller arm plate 813 and the lower roller arm plate 815 start swinging around the shafts X and Y according to shapes of the cam surfaces of the upper roller-moving cam 818*a* and the lower roller-moving cam 819*a*. In the pressure-contact state of the pair of folding rollers 810*a* and 810*b* illustrated in FIG. 9A, the abutment rollers 821*a* and 821*b* do not abut against the cam surfaces and gaps are provided. According to this, pressurizing biasing forces of the pressing springs 817*a* and 817*b* can act on pressurizing contacting portions of the pair of folding rollers 810*a* and 810*b* directly.

Next, if the upper roller-moving cam 818*a* and the lower roller-moving cam 819*a* rotate against the biasing forces and the upper roller arm plate 813 and the lower roller arm plate 815 start swinging, the pair of folding rollers 810*a* and 810*b* start separating from each other. Thereafter, if the upper roller-moving cam 818*a* and the lower roller-moving cam 819*a* rotate to top dead centers (maximum stroke circular regions), the pair of folding rollers 810*a* and 810*b* are brought into the separated state where gaps D are provided as illustrated in FIG. 9B.

As illustrated in FIGS. 5 and 6, a detection sensor flag 830*a* is provided on an end of the moving cam driving shaft (deep side) 820*b*. Rotation positions of the upper roller-moving cam 818*a* and the lower roller-moving cam 819*a* are detected by block or transmission of light of the roller moving cam HP sensor S6 carried out by the detection sensor flag 830*a*.

If the pair of folding rollers 810*a* and 810*b* start separating from each other by rotations of the upper roller-moving cam 818*a* and the lower roller-moving cam 819*a* (S902), the saddle stitch bookbinding apparatus controlling portion 636 starts monitoring a signal of the roller moving cam HP sensor S6 (S903). If transmission of light of the roller moving cam HP sensor S6 by the detection sensor flag 830*a* is detected (Y in S904), the roller moving cam driving motor M6 is stopped (S905). According to this, the upper roller-moving cam 818*a* and the lower roller-moving cam 819*a* are stopped, the pair of folding rollers 810*a* and 810*b* are separated from each other as illustrated in FIG. 10, and the roller separation processing is completed. After the roller separation processing is completed, by returning the projecting member 830, it is possible to reduce a load resistance caused by nip pressures of the pair of folding rollers 810*a* and 810*b* when the projecting member 830 returns.

After the roller separation processing is completed, if the tip end of the sheet bundle on the side of the crease reaches the press unit 860, roller abutting processing is started. In this case, the roller moving cam driving motor M6 is rotated from the separated state illustrated in FIG. 9B (S911), and the moving cam driving shaft (front side) 820*a* is rotated in the direction of arrow Z. According to this, the abutment rollers 821*a* and 821*b* follow biasing forces of the pressing springs 817*a* and 817*b* and lowering cam curved surfaces of the upper roller-moving cam 818*a* and the lower roller-moving cam 819*a*. As a result, the upper roller arm plate 813 and the lower roller arm plate 815 swing around the shafts X and Y, and the pair of folding rollers 810*a* and 810*b* start abutting (S912).

Next, if the pair of folding rollers 810*a* and 810*b* start abutting (S912), monitoring of a signal of the roller moving cam HP sensor S6 is started (S914). If block of light of the roller moving cam HP sensor S6 by the detection sensor flag 830*a* is detected (Y in S914), the roller moving cam driving motor M6 is stopped (S915). According to this, the upper roller-moving cam 818*a* and the lower roller-moving cam 819*a* stop, and the pair of folding rollers 810*a* and 810*b* return to the abutted state as illustrated in FIG. 9A.

Figure 11:
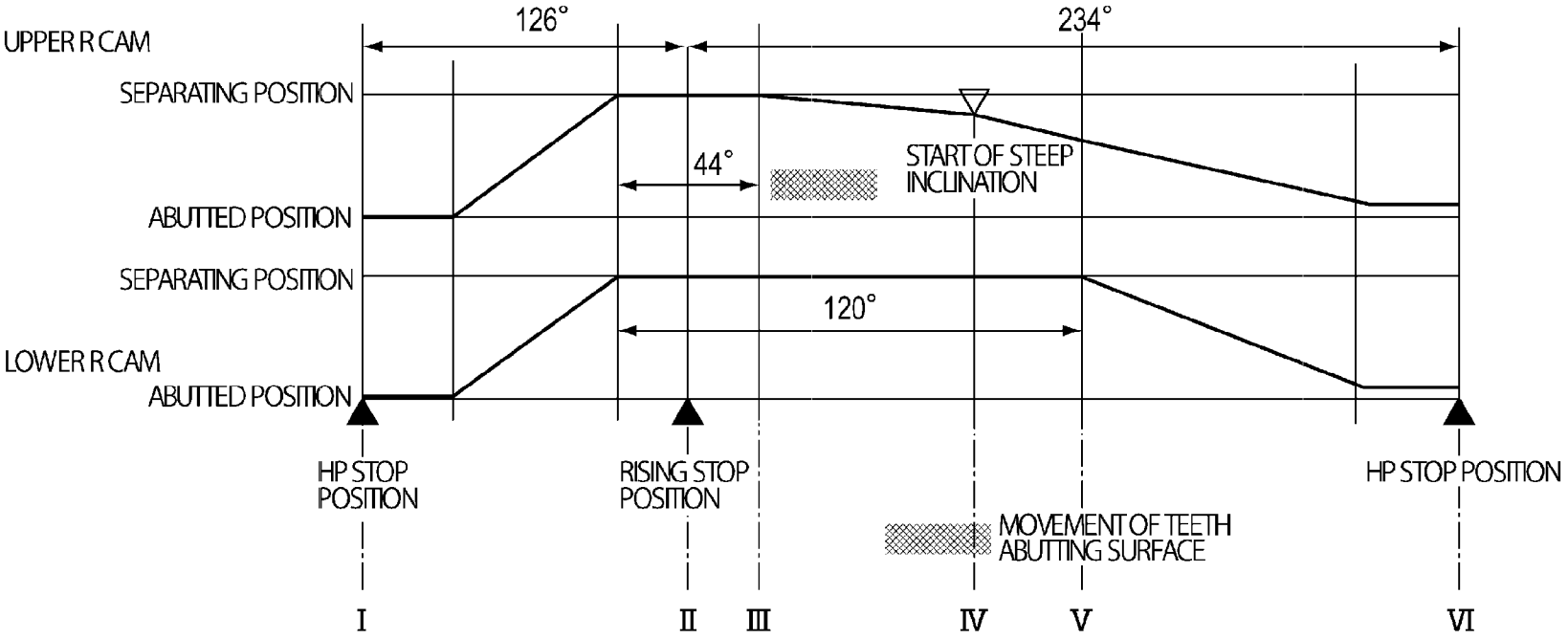
FIG. 11 is cam curve profiles of upper roller-moving cams and lower roller-moving cams of the roller moving mechanism.

FIG. 11 illustrates cam curve profiles of the upper roller-moving cams (upper R cams) 818*a* and 818*b*, and the lower roller-moving cam (lower R cams) 819*a* and 819*b*. FIGS. 12A to 13C are diagrams for explaining operations of the upper roller-moving cams 818*a* and 818*b* and the lower roller-moving cams 819*a* and 819*b*.

Figure 12A:
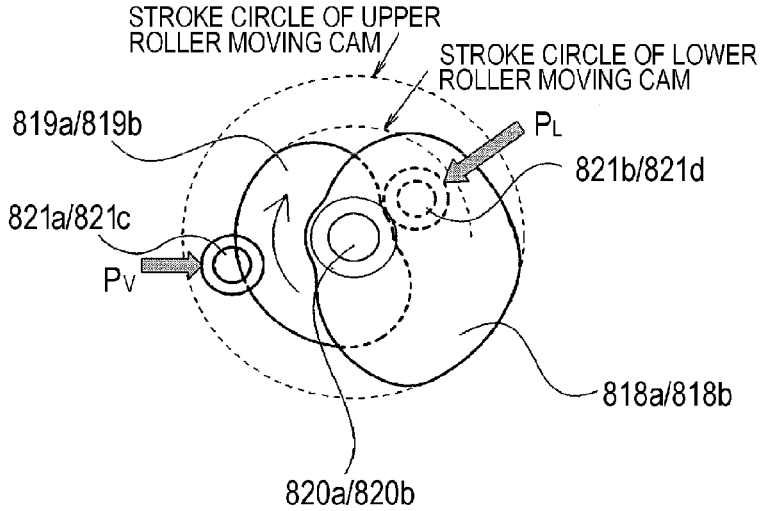
FIGS. 12A, 12B, and 12C are first diagrams for explaining operations of the upper roller-moving cams and the lower roller-moving cams.
Figure 12B:
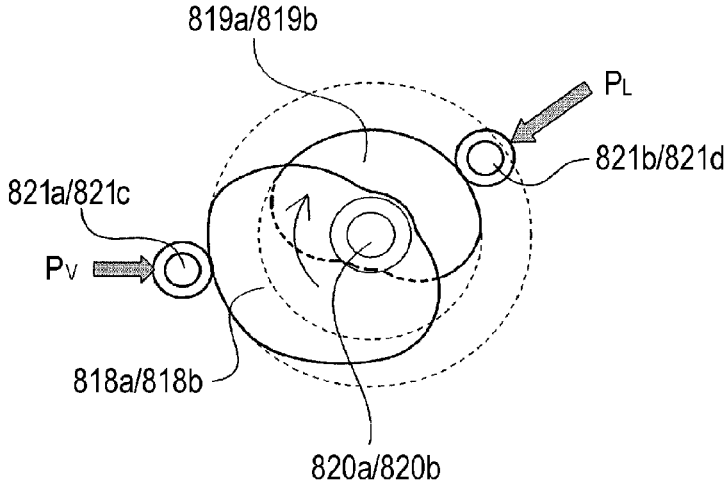

FIG. 12A illustrates a positional relation between the upper roller-moving cams 818*a* and 818*b* and the lower roller-moving cams 819*a* and 819*b* when the pair of folding rollers 810*a* and 810*b* abut, and FIG. 12A correspond to a position I of a time series graph in FIG. 11. From this state, the moving cam driving shafts 820*a* and 820*b* are rotated in a direction of arrow (clockwise direction). According to this, roller moving cams 818*a*, 818*b*, 819*a* and 819*b* start rotating, and the abutment rollers 821*a* to 821*d* abut against the roller moving cams 818*a*, 818*b*, 819*a* and 819*b* by this rotation as illustrated in FIG. 12B.

Thereafter, if the roller moving cams 818*a*, 818*b*, 819*a*, and 819*b* rotate, the abutment rollers 821*a* to 821*d* move such as to follow rising cam curved surfaces of the roller moving cams 818*a*, 818*b*, 819*a*, and 819*b*. With this, the pair of folding rollers 810*a* and 810*b* start separating from each other.

Next, the roller moving cams 818*a*, 818*b*, 819*a*, and 819*b* soon reach their top dead centers (maximum stroke circular regions). This state corresponds to a position II in the time series graph in FIG. 11 and with this, the abutment rollers 821*a* to 821*d* follow the rising cam curved surfaces of the roller moving cams 818*a*, 818*b*, 819*a* and 819*b*, and the moving amount reaches the maximum amount, and the pair of folding rollers 810*a* and 810*b* assume the maximum separated positions. If the top dead centers of the roller moving cams 818*a*, 818*b*, 819*a*, and 819*b* match with each other, the pair of folding rollers 810*a* and 810*b* reach the maximum separated positions at the same time.

Figure 12C:
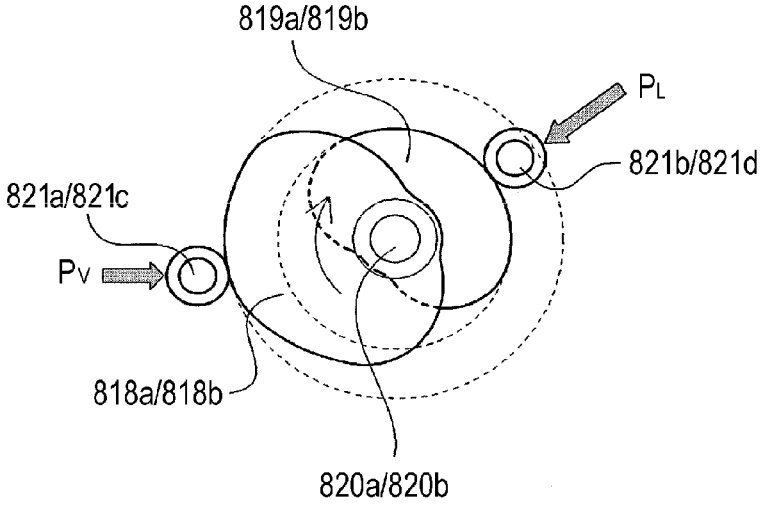

If the moving cam driving shafts 820*a* and 820*b* are further rotated from this state, the abutment rollers 821*a* and 821*c* reach lowering points of cam curved surfaces of the upper roller-moving cams 818*a* and 818*b* as illustrated in FIG. 12C. This position is a position III in FIG. 11. As illustrated in FIG. 11, the lowering cam curved surfaces of the upper roller-moving cams 818*a* and 818*b* include gentle lowering cam curved surfaces and steeply-inclined lowering cam curved surfaces.

After they reach this positions, the abutment rollers 821*a* and 821*c* start moving gently toward a center shaft such as to follow the lowering cam curved surface forming gentle lowering regions of the upper roller-moving cams 818*a* and 818*b*. With this, the upper folding roller 810*a* of the pair of folding rollers 810*a* and 810*b* starts moving in an abutting direction against the lower folding roller 810*b*.

Here, when the abutment rollers 821*a* and 821*c* start moving such as to follow the lowering cam curved surface, biasing forces Pv of pressing springs 817*a* and 817*c* illustrated with arrows are applied to the upper roller-moving cams 818*a* and 818*b* through the abutment rollers 821*a* and 821*c*. According to this, moment for rotating the upper roller-moving cams 818*a* and 818*b* in a direction opposite from the direction of arrow is generated in the upper roller-moving cams 818*a* and 818*b*.

By the application load effect from a side of the abutment rollers 821*a* and 821*c* (load resistance side) in the reverse rotation direction, tooth abutting surfaces of tooth surface meshing portions of gears of the driving transmission gears 828*a*, 828*b*, 829*a*, and 829*b* are shifted in the opposite direction in this instant of time. In this manner, in this embodiment, tooth abutting surface movement illustrated with a diagonal line region is generated between the position III and a position IV in FIG. 11. Cam curve profiles of the upper roller-moving cams 818*a* and 818*b* between the position III and the position IV are gently inclined cam curved surfaces, and rotation moment applied to rotate the upper roller-moving cams 818*a* and 818*b* in the direction of arrow is reduced to a small level without limit.

At that time, the abutment rollers 821*b* and 821*d* are on the top dead centers (maximum stroke circular regions) of the lower roller-moving cams 819*a* and 819*b* and thereafter, the abutment rollers 821*b* and 821*d* are stabilized at the maximum separated position for a while without moving from the top dead center positions. Here, when the lower roller-moving cams 819*a* and 819*b* are located on the top dead centers in this manner, drag F (surface friction force μ between the cam and the roller μ biasing force $P_L$ of the pressing spring) is generated in the moving cam driving shafts 820*a* and 820*b* in the direction of arrow. According to this, drag F is applied to the lower roller-moving cams 819*a* and 819*b* in a direction reducing the rotation moment with respect to the rotation moment for rotating the upper roller-moving cams 818*a* and 818*b*, and it is possible to further reduce the impact force when the tooth abutting surface moves.

A relation of abutting forces of the abutment rollers 821*a* to 821*d* which abut against the upper roller-moving cams 818*a* and 818*b* and the lower roller-moving cams 819*a* and 819*b* is set so that an abutting force of the abutment rollers 821*b* and 821*d* which abut against the lower roller-moving cams 819*a* and 819*b* is larger than that of the abutment rollers 821*a* and 821*b* which abut against the lower roller-moving cams 818*a* and 818*b*. Therefore, it is possible to increase the drag F (surface friction force m between the cam and the roller biasing force PL of the pressing spring), and to reduce the impact force when the tooth abutting surface moves.

Figure 13A:
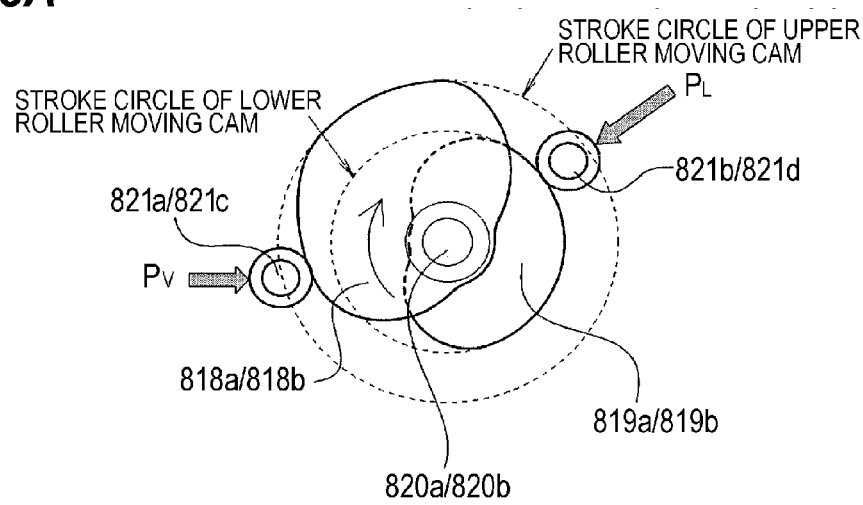
FIGS. 13A, 13B, and 13C are second diagrams for explaining operations of the upper roller-moving cams and the lower roller-moving cams.

If the moving cam driving shafts 820*a* and 820*b* are further rotated, a state where the abutment rollers 821*b* and 821*d* which abut against the lower roller-moving cams 819*a* and 819*b* are located on the top dead centers is maintained as illustrated in FIG. 13A. The abutment rollers 821*a* and 821*c* which abut against the upper roller-moving cams 818*a* and 818*b* move on the steeply-inclined cam curved surface. This is a position IV in FIG. 11.

Figure 13B:
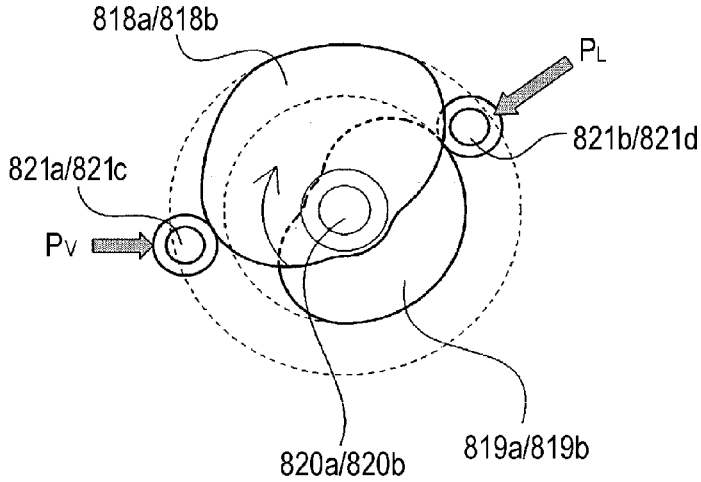

If the moving cam driving shafts 820*a* and 820*b* are rotated, the abutment rollers 821*b* and 821*d* reach lowering points of the lower roller-moving cams 819*a* and 819*b* as illustrated in FIG. 13B. This is a position V in FIGS. 12A and 12C. After the abutment rollers 821*b* and 821*d* reaches the positions, the abutment rollers 821*b* and 821*d* start moving toward the center shaft such as to follow the lowering cam curved surfaces of the lower roller-moving cams 819*a* and 819*b*. According to this, the lower folding roller 810*b* of the pair of folding rollers 810*a* and 810*b* starts moving in the abutting direction against the upper folding roller 810*a* behind the start of moving of the upper folding roller 810*a* in the abutting direction against the upper folding roller 810*b* .

Figure 13C:
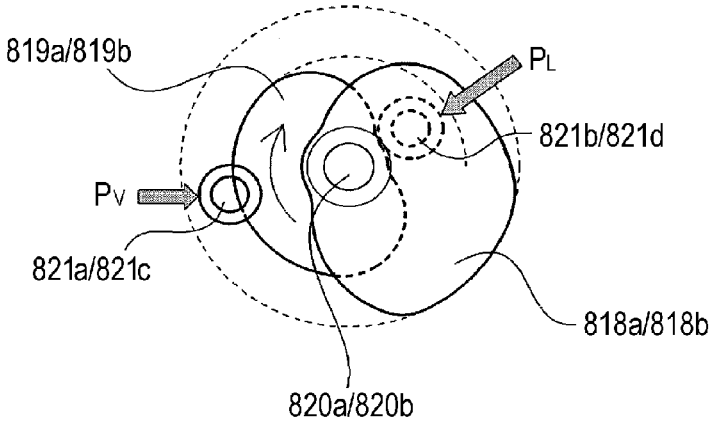

Thereafter, if the moving cam driving shafts 820*a* and 820*b* are further rotated, the abutment rollers 821*a* to 821*d* are brought into a state illustrated in FIG. 13C where gaps are provided with the roller moving cams 818*a*, 818*b*, 819*a*, and 819*b*. According to this, the state is returned to a state where the pair of folding rollers 810*a* and 810*b* illustrated in FIG. 12A abut each other. This is a position VI in FIGS. 12A to 12C.

As described above, in the embodiment, the roller moving cams 818*a*, 818*b*, 819*a*, and 819*b* are rotated at the same time, the upper roller arm plates 813 and 814 and the lower roller arm plates 815 and 816 are swung, and the pair of folding rollers 810*a* and 810*b* are separated from each other. When the pair of folding rollers 810*a* and 810*b* are to be abutted against each other, the upper roller arm plates 813 and 814 and the lower roller arm plates 815 and 816 are swung with different timing in a direction in which the pair of folding rollers 810*a* and 810*b* abut against each other.

By swinging the upper roller arm plates 813 and 814 and the lower roller arm plates 815 and 816 with different timing as described above, an impact force when the pair of folding rollers 810*a* and 810*b* move from the separated positions to the abutted position can be reduced. By reducing the impact force when the pair of folding rollers 810*a* and 810*b* move from the separated positions to the abutted position, it is possible to reduce noise and to enhance durability.

By separating the pair of folding rollers 810*a* and 810*b* from each other, it is possible to reduce a load resistance caused by nip pressure of the pair of folding rollers 810*a* and 810*b* when the projecting member returns. When a paper jam occurs around the pair of folding rollers 810*a* and 810*b*, taking out properties of a sheet bundle can be enhanced by separating the pair of folding rollers 810*a* and 810*b* from each other.

In the embodiment, as described above, after the tip end of the sheet bundle which has passed through the pair of folding rollers 810*a* and 810*b* is conveyed to the press unit 860, the sheet bundle is stopped. In this case, as a phenomenon of a thick sheet bundle which is folded in the middle, an inclined surface of a small opening cross section is generated between the innermost sheet of the sheet bundle and the outermost sheet. When the sheet bundle is stopped in this manner, the small opening end which is on the opposite side from the crease of the sheet bundle matches with a nip position of the pair of folding rollers 810*a* and 810*b* depending on the size. In this case, a nip pressure of the pair of folding rollers 810*a* and 810*b* is applied to the inclined surface, a force which tries to move the sheet bundle in the downstream direction is generated and therefore, the precision of the stop position is not stable.

According to the embodiment, as described above, after a tip end of the sheet bundle on the side of the crease reaches the pair of first folding conveyance rollers 811*a* and 811*b*, the pair of folding rollers 810*a* and 810*b* are brought into the separated state from the pressure-contact state. Therefore, nip pressure of the pair of folding rollers 810*a* and 810*b* is not applied to the inclined surface of the small opening end of the sheet bundle, and the precision of the stop of the sheet bundle after it is conveyed to the press unit 860 is stable.

In the roller moving mechanism 800A, it is possible to control the rotation amount of the roller moving cam driving motor M6 by the roller moving cam HP sensor S6 according to the number of sheets of the sheet bundle. According to this, it is possible to adjust the abutted position between the roller moving cams 818*a*, 818*b*, 819*a*, and 819*b* and the abutment rollers 821*a* to 821*d*, and to adjust a separating amount of the pair of folding rollers 810*a* and 810*b*.

For example, there are a case where a sheet bundle which is to be subjected to saddle stitch processing is thick and a case where a rigid sheet is to be folded in the middle. In such cases, the pair of folding rollers 810*a* and 810*b* are separated from each other before the sheet bundle is moved to the nip portion of the pair of folding rollers 810*a* and 810*b* by the projecting member 830 so that a distance between the pair of folding rollers 810*a* and 810*b* is slightly smaller than a thickness of the sheet bundle which is to be saddle stitched. According to this, when the sheet bundle is moved to the nip portion of the pair of folding rollers 810*a* and 810*b* by the projecting member 830, the sheet bundle is easily bitten between the pair of folding rollers 810*a* and 810*b*. At that time, if a separating amount of rollers is set to a distance which is slightly smaller than the saddle stitch folding bundle thickness, nip pressure is not applied at a small level. Then, the folding properties are not deteriorated.

In this embodiment, front side and deep side cam curved surface profiles of the upper roller-moving cams 818*a* and 818*b* and the lower roller-moving cams 819*a* and 819*b* are the same, but phase differences may be provided on the front side and the deep side, and the peak point of load may be deviated. Not only the pair of folding rollers 810*a* and 810*b* but also the pair of first folding conveyance rollers 811*a* and 811*b* and the pair of second folding conveyance rollers 812*a* and 812*b* may be separated.

Figure 14A:
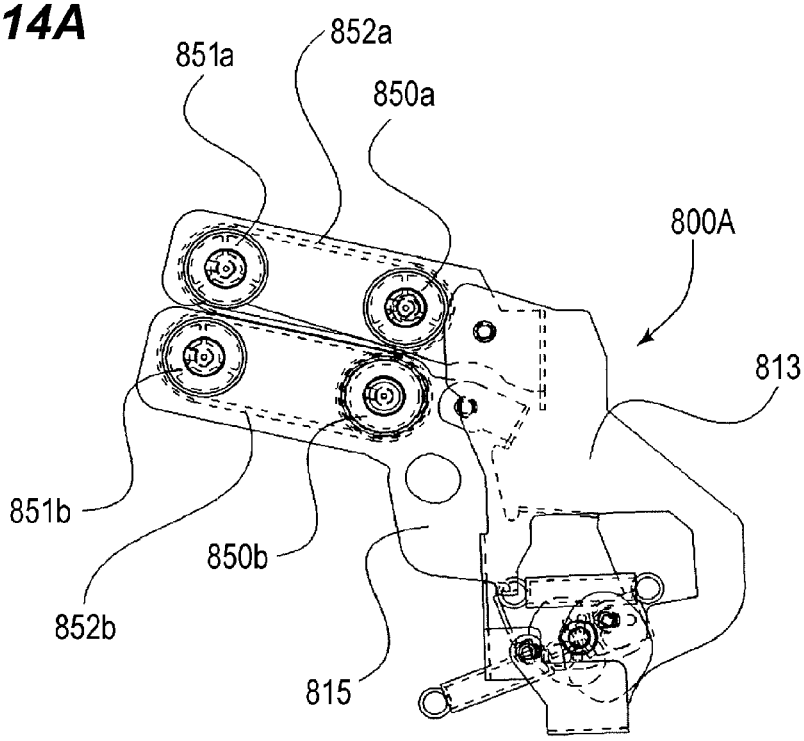
FIGS. 14A and 14B are first diagrams for explaining another configuration of the embodiment.
Figure 14B:
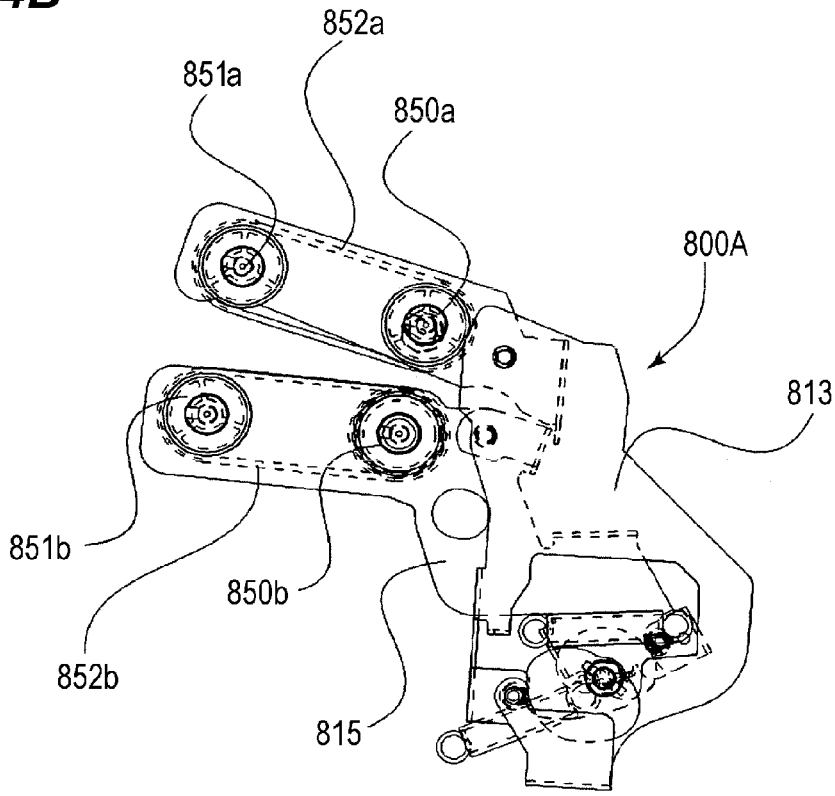

As another configuration of this embodiment, a sheet bundle is folded in the middle by a pair of folding belts which are a pair of sheet conveyance rotating members, not by the pair of folding rollers 810*a* and 810*b*. In this case, as illustrated in FIG. 14, a pair of folding belts 852*a* and 852*b* which are wound around a pair of first conveying rollers 850*a* and 850*b* and a pair of second conveying rollers 851*a* and 851*b* may be separated from each other by the roller moving mechanism 800A.

Figure 15:
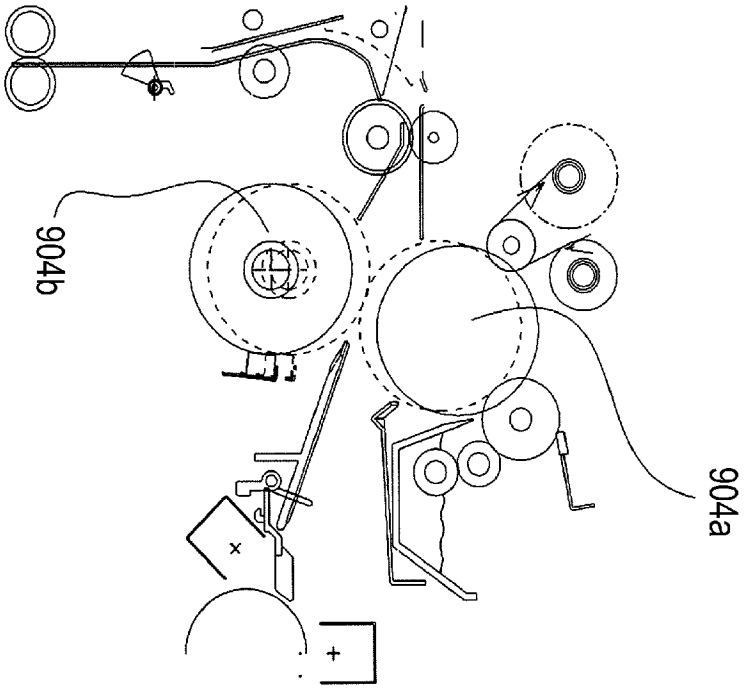
FIG. 15 is a second diagram for explaining another configuration of the embodiment.

Although the roller moving mechanism 800A is applied to the pair of folding rollers 810*a* and 810*b* in the above description, the roller moving mechanism 800A may be applied to a pair of fixing rollers (a pressure roller 904*a* and a fixing roller 904*b*) illustrated in FIG. 15. To fix a toner image transferred onto a sheet surface on the sheet by heat and pressure, the fixing roller 904*b* of the pair of fixing rollers 904*a* and 904*b* is heated to a high temperature, and the fixing portion 904 conveys the sheet in a state where the nip pressure between the rollers is increased.

Therefore, when the sheet retains and stops in the apparatus when a paper jam or an abnormality occurs during the image forming operation, the sheet which is nipped between the pair of fixing rollers 904*a* and 904*b* and stops is left under a high temperature until the sheet is removed. In this case, to prevent the sheet from being excessively heated or to enhance the removing properties of the sheet bitten between the rollers having high nip pressure, the pressure roller 904*a* and the fixing roller 904*b* are separated from each other by the roller moving mechanism 800A having the above-described configuration.

In the case of the conventional roller moving mechanism, an eccentric cam is provided on a roller end of one of the pair of heat fixing rollers, and only one of the rollers is moved. Therefore, it is necessary that the moving amount of the roller which moves in the separating direction must be large. Here, if the moving amount of the roller is increased, time during which the roller is moved, i.e., time during which the pair of heat fixing rollers are separated from each other is increased.

However, if the roller moving mechanism 800A of this embodiment is used, since both the pressure roller 904*a* and fixing roller 904*b* can be moved, and the separating and moving time of the rollers can be made short. As a result, the productivity can be enhanced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-113297, filed May 17, 2010, No. 2011-086662, filed Apr. 8, 2011 which are hereby incorporated by reference herein in their entirety.

What is claimed is:

1. A sheet conveying apparatus comprising:

a pair of sheet conveyance rotating members including a first rotating member and a second rotating member which nip a sheet and convey the sheet; and a moving mechanism which brings the first rotating member and the second rotating member into contact with each other and which separates the first rotating member and the second rotating member from each other, wherein the moving mechanism includes a first cam which moves, against a biasing force in a direction in which the first rotating member abuts against the second rotating member, the first rotating member so that the first rotating member separates from the second rotating member, a second cam which moves, against a biasing force in a direction in which the second rotating member abuts against the first rotating member, the second rotating member so that the second rotating member separates from the first rotating member, and a driving portion which drives the first cam and the second cam, wherein each of the first cam and the second cam has such a cam curved surface that when the first cam and the second cam are rotated by the driving portion, each cam curved surface moves the first rotating member and the second rotating member to each maximum separated position where the first rotating member and the second rotating member are separated from each other, and when the first rotating member and the second rotating member are abutted against each other, each cam curved surface moves the first rotating member and the second rotating member with different timing from each maximum separated position.

2. The sheet conveying apparatus according to claim 1, wherein each cam curved surface of the first cam and the second cam reaches each top dead center at the same time, and has different lowering points at which each of the first rotating member and the second rotating member moves from each top dead center to lowering regions with different timing.

3. The sheet conveying apparatus according to claim 1, wherein the first cam and the second cam are rotated by the same driving source.

4. The sheet conveying apparatus according to claim 1, further comprising:

a first moving member which supports the first rotating member rotatably, and which is movably supported, and a second moving member which supports the second rotating member rotatably, and which is movably supported, wherein each of the first moving member and the second moving member abuts against each cam curved surface of the first cam and the second cam to move the first rotating member and the second rotating member.

5. A sheet processing apparatus comprising:

a pair of folding rotating members including a first rotating member and a second rotating member which convey a sheet bundle while folding the sheet bundle in the middle; and a moving mechanism which brings the first rotating member and the second rotating member into contact with each other and which separates the first rotating member and the second rotating member from each other, wherein the moving mechanism includes a first cam which moves, against a biasing force in a direction in which the first rotating member abuts against the second rotating member, the first rotating member so that the first rotating member separates from the second rotating member, a second cam which moves, against a biasing force in a direction in which the second rotating member abuts against the first rotating member, the second rotating member so that the second rotating member separates from the first rotating member, and a driving portion which drives the first cam and the second cam, wherein each of the first cam and the second cam has such a cam curved surface that when the first cam and the second cam are rotated by the driving portion, each cam curved surface moves the first rotating member and the second rotating member to each maximum separated position where the first rotating member and the second rotating member are separated from each other, and when the first rotating member and the second rotating member are abutted against each other, each cam curved surface moves the first rotating member and the second rotating member with different timing from each maximum separated position.

6. The sheet processing apparatus according to claim 5, wherein each cam curved surface of the first cam and the second cam reaches each top dead center at the same time, and has different lowering points at which each of the first rotating member and the second rotating member move from each top dead center to lowering regions with different timing.

7. The sheet processing apparatus according to claim 5, wherein the first cam and the second cam are rotated by the same driving source.

8. The sheet processing apparatus according to claim 5, further comprising:

a first moving member which supports the first rotating member rotatably, and which is movably supported, and a second moving member which supports the second rotating member rotatably, and which is movably supported, wherein each of the first moving member and the second moving member abuts against each cam curved surface of the first cam and the second cam to move the first rotating member and the second rotating member.

9. An image forming apparatus comprising:

an image forming portion which forms a toner image on a sheet;

a pair of fixing rollers including a first rotating member and a second rotating member which convey the sheet while fixing the toner image formed on the sheet; and a moving mechanism which brings the first rotating member and the second rotating member into contact with each other and which separates the first rotating member and the second rotating member from each other, wherein the moving mechanism includes a first cam which moves, against a biasing force in a direction in which the first rotating member abuts against the second rotating member, the first rotating member so that the first rotating member separates from the second rotating member, a second cam which moves, against a biasing force in a direction in which the second rotating member abuts against the first rotating member, the second rotating member so that the second rotating member separates from the first rotating member, and a driving portion which drives the first cam and the second cam, wherein each of the first cam and the second cam has such a cam curved surface that when the first cam and the second cam are rotated by the driving portion, each cam curved surface moves the first rotating member and the second rotating member to each maximum separated position where the first rotating member and the second rotating member are separated from each other, and when the first rotating member and the second rotating member are abutted against each other, each cam curved surface moves the first rotating member and the second rotating member with different timing from each maximum separated position.

10. The image forming apparatus according to claim 9, wherein each cam curved surface of the first cam and the second cam reaches each top dead center at the same time, and has different lowering points at which each of the first rotating member and the second rotating member moves from each top dead center to lowering regions with different timing.

11. The image forming apparatus according to claim 9, wherein the first cam and the second cam are rotated by the same driving source.

12. The image forming apparatus according to claim 9, further comprising:

a first moving member which supports the first rotating member rotatably, and which is movably supported, and a second moving member which supports the second rotating member rotatably, and which is movably supported, wherein each of the first moving member and the second moving member abuts against each cam curved surface of the first cam and the second cam to move the first rotating member and the second rotating member.

* * * * *